US007442237B1

(12) United States Patent
Gardner

(10) Patent No.: US 7,442,237 B1
(45) Date of Patent: Oct. 28, 2008

(54) MULTI-AGENT END-OF-SERVICE-LIFE INDICATOR FOR RESPIRATOR FILTERS

(75) Inventor: Paul D. Gardner, Bel Air, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 474 days.

(21) Appl. No.: 11/222,165

(22) Filed: Sep. 8, 2005

Related U.S. Application Data

(60) Provisional application No. 60/610,868, filed on Sep. 16, 2004.

(51) Int. Cl.
*A62B 19/00* (2006.01)

(52) U.S. Cl. ..... 96/117.5; 96/416; 55/DIG. 35; 128/202.22

(58) Field of Classification Search ..... 96/117.5, 96/134, 135, 414–417; 55/DIG. 33, DIG. 35; 127/202.22
See application file for complete search history.

(56) References Cited

U.S. PATENT DOCUMENTS 1,537,519 A * 5/1925 Yablick ..... 422/119
2,249,867 A * 7/1941 Snelling ..... 73/335.08
3,635,001 A * 1/1972 Komroff et al. ..... 96/417
3,966,440 A * 6/1976 Roberts ..... 96/117.5
4,154,586 A * 5/1979 Jones et al. ..... 96/117.5
4,155,358 A * 5/1979 McAllister et al. ..... 128/202.22
4,326,514 A * 4/1982 Eian ..... 128/202.22
4,365,627 A * 12/1982 Wing ..... 128/202.22
4,530,706 A * 7/1985 Jones ..... 96/117.5
4,684,380 A * 8/1987 Leichnitz ..... 96/117.5
6,497,756 B1 * 12/2002 Curado et al. ..... 96/117.5
6,979,361 B2 * 12/2005 Mihayiov et al. ..... 96/26

FOREIGN PATENT DOCUMENTS

DE 2758603 A1 * 7/1978

* cited by examiner

*Primary Examiner*—Frank M Lawrence
(74) *Attorney, Agent, or Firm*—Ulysses John Biffoni

(57) ABSTRACT

An end-of-service-life-indicator for a multi-agent respirator filter that is safe, reliable, and easy to read and may be configured to cover a broad range of threats, including chemical warfare agents and toxic industrial chemicals, is achieved by positioning an array of chemically reactive calorimetric indicators substantially next to a sorbent bed behind a viewing window that may be integrated into the filter housing. Each colorimetric indicator in the array may be configured to produce a color change in responsive to a different target threat or threat category and may be calibrated to display easily identifiable colors, symbols or patterns to indicate an optimum time to exchange a filter.

7 Claims, 7 Drawing Sheets

MULTI-AGENT END-OF-SERVICE-LIFE INDICATOR FOR RESPIRATOR FILTERS

This application claims priority from U.S. Provisional Application Ser. No. 60/610,868, filed Sep. 16, 2004.

GOVERNMENT INTEREST

The invention described herein may be manufactured, licensed, and used by or for the U.S. Government.

TECHNICAL FIELD

The present invention relates in general to monitoring the status of air-purifying filter systems, and more particularly to a system and method for indicating the service-life remaining for a multiple threat agent respirator filter in an air-purifying respirator, and like apparatus.

BACKGROUND

Modern air-purifying respirators targeted to filter a range of threat agents, such as chemical, biological, radiological and nuclear (CBRN) respirators, rely on filter elements that have limited service lives. While these respirators are intended to be worn for protection against threat agent airborne concentrations that are dangerous to life and health, presently, the respirators provide no direct indication of their remaining gas-life capacity. Current military doctrine for determining how often to exchange CBRN mask filters is therefore based on evaluating factors calculated to indirectly indicate the remaining gas life, such as the physical condition of the filter, the type and extent of threat agent exposure, climatic conditions, and other criteria that are known to affect service life. The uncertain and subjective nature of these factors and the consequences of miscalculation have lead to widespread premature disposal of filters. For example, according to military doctrine, during wartime operations, respirator filters in masks that have been worn in areas previously exposed to a chemical attack are to be disposed of after 30 days. In actual practice, however, the respirator filters are often exchanged in a combat environment every 30 days whether or not there has been a confirmed chemical attack. These change-out practices, of course, are deliberately conservative but they impose substantial additional costs and logistic burdens on military and civilian authorities responsible for maintaining an adequate supply of replacement filters. Even conservative filter change-out practices provide no absolute assurance that a respirator filter is still effective.

Military and emergency responder communities including security and law enforcement personnel, tactical response units, health care workers, and a growing number of other users require a more reliable and objective means to determine when to replace a CBRN filter. Embodiments according to the present invention address these concerns, at least in part.

SUMMARY

In general, in one aspect, an embodiment of a calorimetric display for signaling an end of service life condition for a multi-agent air-purifying respirator filter according to the present invention, includes a number of adjacent colorimetric indicator elements, each element configured to produce a distinct color change in response to detection of a predetermined level of penetration through a sorbent filter media of the respirator filter of a distinct chemical threat agent or threat agent category.

In general, in another aspect, an embodiment of a colorimetric indicator according to the present invention includes a substrate coated with a reactive chemical compound that produces an indication comprising a distinct color change in response to detection of a CBRN target chemical threat agent, a mask overlay substantially conforming in color to the substrate before a colorimetric reaction has occurred, that selectively displays a region of the substrate configured to change color at a predetermined level of exposure to the target chemical threat agent; and a protective backing that is permeable by the target chemical threat agent or threat agent category. In another aspect, the reactive chemical compound is selected from a group that essentially includes of Cu(TPP), Metanil yellow (3-(4-Anilinophenylazo)benzenesulfonic acid) monosodium salt, Rosolic acid (basic form), Bromocresol green (acid), Congo Red (1-Napthalensulfonic acid), Zn(TPP) and Bromocresol purple (acid).

In yet another aspect, a method for displaying an end of service life signal for a sorbent filter media housed in a filter element of a respirator for filtering a number of CBRN threat agents includes positioning a number of chemically reactive calorimetric indicator elements in contact with the sorbent filter media, configuring each colorimetric indicator element to display a distinct color change signal in response to detection of a distinct chemical threat agent or threat agent category, providing at least one window integrated into the filter element housing for viewing signals produced by the plurality of chemically reactive calorimetric indicator elements, calibrating the colorimetric indicator elements to display signals corresponding to predetermined maximum levels of filter penetration by the distinct chemical threat agent or threat agent category; and formatting the display of color change signals to produce one or more patterns, shapes or symbols.

DETAILED DESCRIPTION

Figure 1:
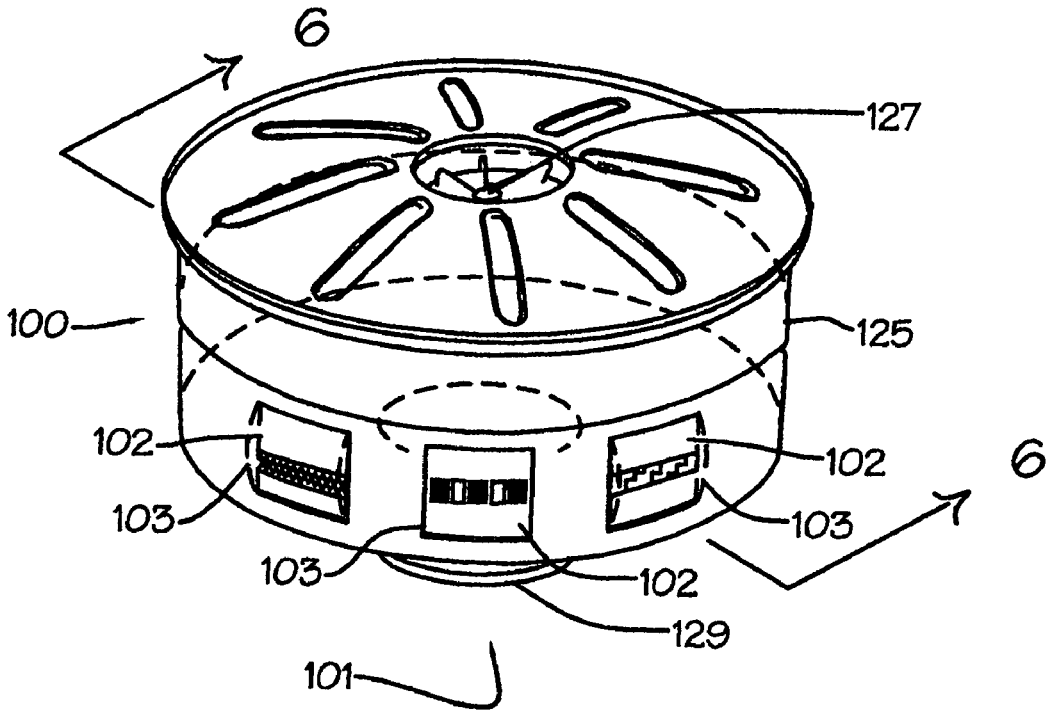
FIG. 1 shows a front perspective view of an embodiment of a multi-threat-agent multi-detector colorimetric ESLI in a threaded CBRN respirator filter according to the present invention.

In the following detailed description, reference is made to the accompanying drawings that form a part hereof, and in which are shown by way of illustration specific embodiments in which the invention, as claimed, may be practiced. This invention may, however, be embodied in many different forms and should not be construed as limited to the embodiments set forth; rather, these embodiments are provided so that this disclosure will be thorough and complete, and will fully convey the scope of the invention to those skilled in the art. As will be appreciated by those of skill in the art, the present invention may be embodied in methods, systems and devices. Wherever possible, the same reference numbers will be used throughout the drawings to refer to the same or like parts.

Embodiments according to the present invention will significantly expand the capability and reliability of air-purifying respirators used to provide protection against chemical threat agents including Chemical Warfare Agents (CWAs) and Toxic Industrial Chemicals (TICs) by providing a clear and timely warning signal that indicates the need for a new filter before the gas life capacity of the filter is at an end. Anxiety and worry about personal safety in CBRN threat environments will thus be reduced for wearers of such masks. Additional benefits will include reduced cost and logistical burdens associated with premature filter exchange based on conservative (safe-sided) change-out schedules. The term "End of Service Life Indicator" (ESLI) as used herein, encompasses, Residual Life Indicators and indicators that signal when it is appropriate or prudent to change the filter whether or not the filter has actually reached the end of its gas life or gas life expectancy. The term "filter" as used herein includes gas mask or respirator canisters and cartridges, other types of replaceable respirator filter elements, disposable respirators, escape masks and the like, used for or in connection with personal air-purifying breathing apparatus. "Threat agent" as the term is used herein is meant to include any toxic airborne Chemical Warfare Agent (CWA) or Toxic Industrial Chemical (TIC).

A number of technologies exist that could be tailored to detect toxic vapors/gases and thus could potentially serve as End of Service Life Indicators (ESLIs) for CBRN filters. These technologies generally fall into two very broad categories: passive devices that require no power supply such as devices that produce an indication as part of a chemical reaction, and active devices that rely on some form of power supply such as solid-state gas sensor technology. Colorimetric indicators are passive chemical devices and offer many advantages over solid-state chemical detection technologies (e.g., chemiresistors, metal oxide gas sensors, electrochemical, etc.). They are inexpensive, easy to mass produce, highly sensitive, require no power supply or electronic circuitry, have a relatively long shelf life, and can be formulated to react to an appropriately wide range of CWAs and TICs. Their small size and low profile allow them to be integrated into the filter element of a CBRN respirator without compromising filter performance or requiring extensive redesign of the filter or mask.

While relatively simple colorimetric indicators have been incorporated into conventional breathing devices such as workplace contaminant respirators, industrial water and gas filtration systems, and the like, these indicators lack sensitivity, fail to provide timely warnings of impending filter failure, and/or fail to detect many threat agents. The ever broadening spectrum of threat agents of military and counter-terrorism significance and the minute concentrations at which they can produce casualties further complicates the design of an ESLI for a CBRN filter system. Moreover, to be practical, an ESLI should allow sufficient advance warning for a user to take notice of the ESLI signal and change out the filter no matter how rapidly the threat agent may progress through the filter. Embodiments according to the present invention employ an array of colorimetric indicators, each targeted to detect a different threat agent or threat agent group and calibrated to provide timely ESLI signals in response to detection of predetermined levels of threat agent or threat agent groups in the filter. ESLIs in embodiments according to the present invention thus provide reliable, multi-threat-agent end-of-service-life indications in response to a variety of threat agents and are suitable for use in CBRN respirators, or similar devices.

CBRN filters typically contain at least two basic types of media: a sorbent filter media that includes granular activated carbon for gas/vapor adsorption and a particulate media that provides high efficiency particulate air (HEPA) filtration to protect against liquid and solid chemical aerosols and particulate threats of biological origin (e.g., bacteria, viruses, and toxins). Reactants such as metal salts and other specially formulated compounds to neutralize or remove a variety of CWAs and other toxic vapors and gases are also typically impregnated in the sorbent media or may be provided in a separate layer.

A HEPA filter essentially provides its own end of service life indication. After extended filtration of airborne particulates, the HEPA filter will become clogged with trapped particles and breathing through the respirator will become progressively and noticeably more difficult. No immediate hazard is presented to the wearer since the clogged media will continue to filter particulates and actually do so with greater efficiency.

The carbon sorbent/chemically impregnated media ("sorbent media") operates in a different way from the HEPA filter. The sorbent media removes relatively low vapor pressure organic vapors such as nerve and blister agents (e.g., sarin and mustard gas, respectively) by physical adsorption in microporous structures of the carbon media. Relatively high vapor pressure inorganic gases (e.g., hydrogen cyanide, phosgene, and cyanogen chloride) are removed through chemical adsorption, i.e., chemical reactions with the impregnates that cause decomposition or neutralization of target threat agents. During extended gas exposures, the microporous surfaces of the sorbent media gradually become saturated leading to progressively greater migration of the vapor through the packed sorbent bed of the filter. The chemical impregnates are also eventually exhausted after extended exposure to chemical threat agents that react with them. Neither of these failure modes will likely be noticeable to the wearer and may occur quite rapidly under some circumstances. The amount of time it takes for the occurrence of an end of service life event such as toxic vapor penetration to a predetermined level of the filter bed or "breakthrough" of a threat agent, depends on a number of factors, including bed depth, adsorbent/reactant makeup and performance, linear air flow velocity (breathing flow rate), airflow distribution over and through the filter media, threat agent challenge vapor and concentration, operating temperature, and humidity. Embodiments according to the present may be configured and calibrated to account for such variables in order to provide reliable ESLI signals with appropriate safety margins under a wide variety of circumstances.

In the preferred embodiment of an ESLI according to the present invention, an array of three separate colorimetric indicators each targeting a specific contaminant, group, or class of CWAs and/or TICs is provided. The indicators are displayed in one or more viewing windows in the housing of a CBRN filter. The number of indicators and the type may be altered to target threat agents or groups of threat agents of interest to the CBRN respirator filter user. Some detection overlap between colorimetric indicators may be provided for redundancy and cross checking. The viewing window(s) are located next to the sorbent bed so that the indicators are in position to signal before a harmful level of any target threat agent passes through the filter. The sensitivity of the indicators and/or their placement in relation to the sorbent bed may be adjusted to signal the need to exchange filters at levels of sorbent media penetration corresponding to individual target threat agents or target threat agent category. Embodiments of ESLIs according to the present invention may also be provided in auxiliary filter elements targeted more specifically to a contaminant or contaminant group and/or configured for attachment over another filter element.

Figure 2:
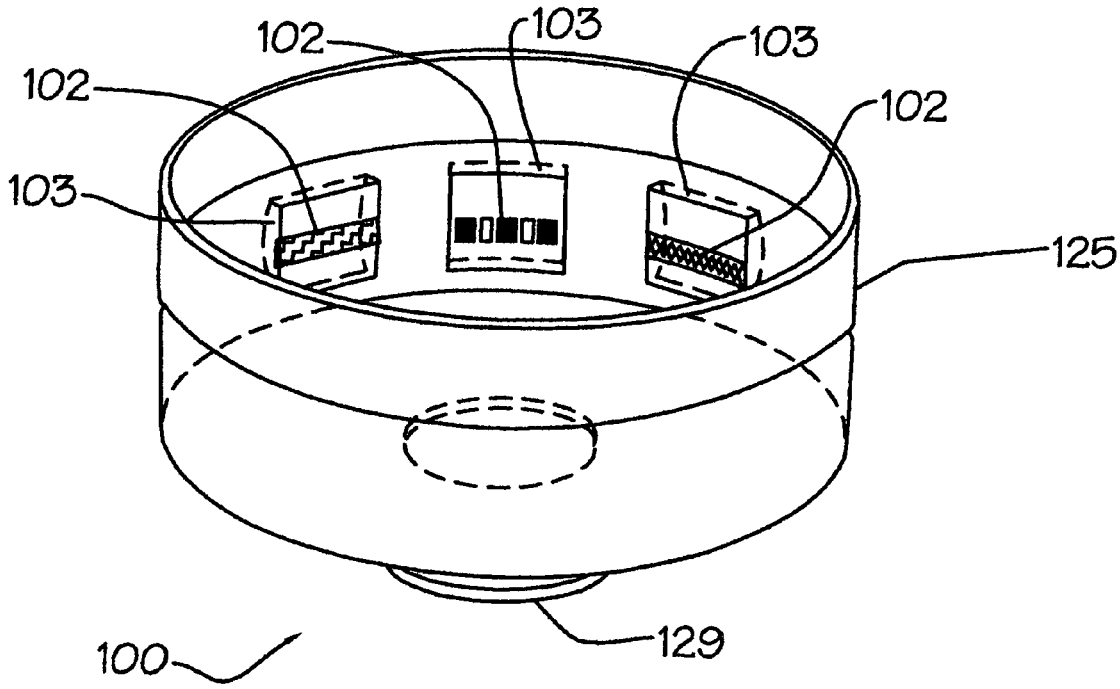
FIG. 2 shows a front perspective view of the inside of the filter housing of the threaded CBRN respirator filter illustrated in FIG. 1.

FIG. 1 shows an external view of a preferred embodiment of a multi-threat-agent multi-detector ESLI assembly 101 integrated into a threaded type CBRN respirator filter 100 such as the C2A1 used in M40-series air-purifying respirators widely deployed by the U.S. joint services. FIG. 2 shows a perspective view of the inside of filter 100 without the presence of air filtration media. Filter 100 includes a metal or molded plastic housing 125 with an air inlet port 127 at the top and an air outlet port 129 at the bottom. Filter 100 is a replaceable component of the respirator (not shown) and is secured to the respirator by threading or otherwise engaging outlet port 129 into a corresponding connector of the respirator. Housing 125 encloses a conventional packed assembly of air filtration media, including, as shown generally in FIG. 6, a HEPA particulate media 130, a carbon/chemi sorbent filter media 120 and a carbon fines filter 122 to prevent passage of any loose carbon particles into the respirator mask. An air plenum 128 provides a small chamber above the filter media to distribute airflow through the filter media. In this example, carbon/chemi sorbent filter media 120 is approximately 2 cm deep and provides a single homogeneous layer of sorbent media responsive to multiple threat agents. Stacked or multi-layered carbon-based or non-carbon based sorbent media impregnated with metal oxides as well as a number of different reactive chemical compounds targeted to different threat agents may also be provided in alternative embodiments. The bed depth and other dimensions of carbon/chemi sorbent filter media 120 and other filter elements will also vary depending on the design of a particular filter.

Filter 100 provides a multi-threat-agent multi-detector ESLI assembly 101 that incorporates an array of three colorimetric indicator elements 102. Indicator elements 102 in this embodiment are mounted behind separate viewing windows 103. While colorimetric indicator elements 102 are similar in appearance and design, each element is configured to respond to different threat agents or threat agent category and may also display different visual indications in both the exposed and unexposed states. Viewing windows 103 are preferably made from a transparent polymer such as a polycarbonate that is resistant to a wide variety of chemicals and may be molded into housing 125 of filter 100 prior to installation of colorimetric indicators 102 by a manufacturing process such as injection molding, blow or vacuum molding, extrusion, or the like. Alternatively, viewing windows 103 may be friction fit into housing 125 or adhered with an adhesive. Viewing windows 103 are preferably polished or otherwise finished to provide an optical quality surface.

Figure 6:
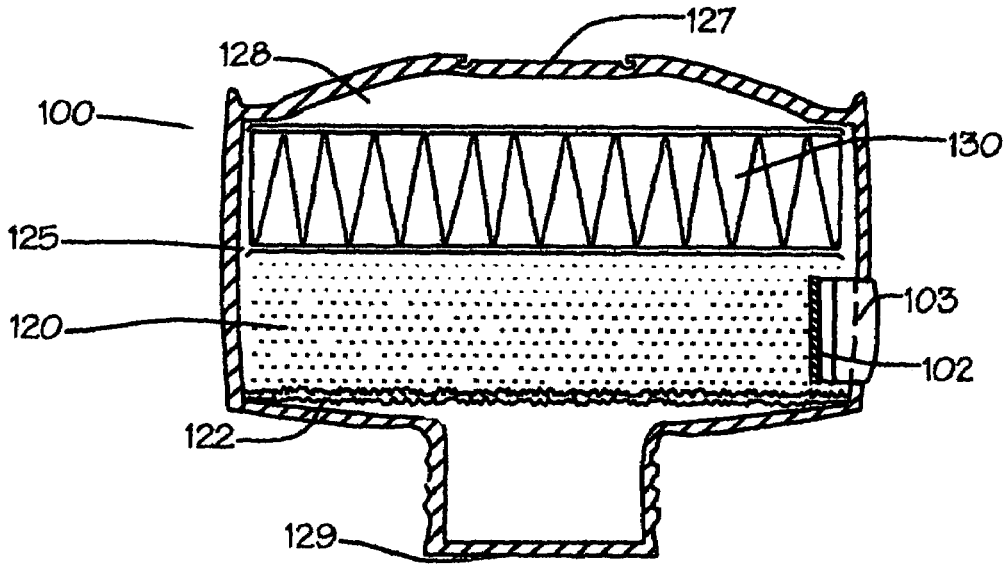
FIG. 6 shows a cross-section view of the threaded CBRN respirator filter illustrated in FIGS. 1 and 2.
Figure 7:
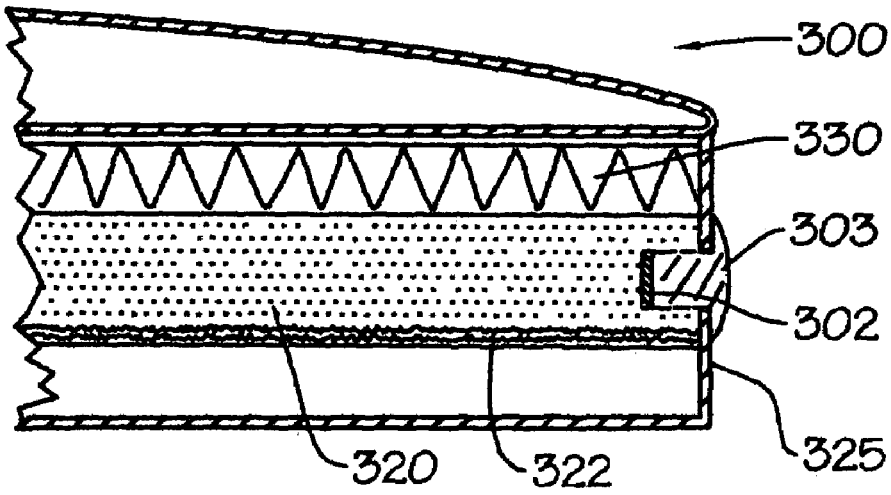
FIG. 7 shows a cross sectional broken view of the "bayonet"-type CBRN respirator filter illustrated in FIGS. 3 and 4.

Viewing windows 103 are positioned so that each indicator 102 makes contact with an area of sorbent media 120 that is suitable for detecting a distinct chemical threat agent or threat agent category. While the exact size and positioning will vary depending on the particular filter, three viewing windows 103 each approximately 2.5 cm in length, 1.0 cm in height may be incorporated into a C2A1 CBRN filter such as filter 100. The thickness of each window 103 may be adjusted to ensure suitable contact is made with sorbent media 120. For example, as shown in FIG. 6, viewing window 103 is broad enough to position calorimetric indicators 102 in an area of the sorbent media where there is sufficient airflow. As shown in FIG. 7, in low profile filter 300, a viewing window 303 has been broadened to position calorimetric indicators 302 in an area of the sorbent media that is away from the sidewall of the filter housing 325 where there is better airflow through carbon/chemi sorbent media 320.

Because CBRN respirators may be used in a variety of harsh environments where visibility is limited, the preferred embodiment of an ESLI according to the present invention provides "go no-go" signals which can be read and easily interpreted at a glance. In alternative embodiments a legend may also be provided to decode signals or signal combinations so that threat agents or threat agent concentrations may be determined.

A number of other factors come into play in designing a multi-threat-agent multi-detector ELSI that provides simple and reliable indications of filter gas life expectancy in response to multiple threat agents. An ELSI display can easily become confusing and difficult to interpret if indications are not displayed properly, especially since the display areas may be quite small. To reduce the potential for confusion, multi-threat-agent, multi-detector ESLIs in embodiments according to the present invention are configured to display colors, symbols, patterns, shapes and forms that convey simple, clear, and distinct "go no-go" signals that can be read and understood at a glance. To further reduce the potential for confusing signals, adjacent indicator elements 102 and 302 are spaced to ensure visually distinct display elements. For example, as shown in FIGS. 1 and 2, the use of separate, equally spaced viewing windows 103 for each calorimetric indicator element 102 helps to delineate signals provided by each element and facilitates more rapid interpretation of the results. Placement of indicator elements 102 against a background of contrasting and dark material also generally will improve readability of signals. While space provided between adjacent viewing windows 103 should be adequate to provide a distinct demarcation of signals from each indicator element 102, ESLI 101 should not be so large that the overall display cannot be viewed from one vantage point. To further enhance visibility without increasing the size of ESLI 101, as shown in FIGS. 1-7, viewing windows 103 and 303 may be provided with external convex surfaces or lenses to magnify the indicator signals. This feature may be particularly useful in embodiments for low-profile filters where the viewing window is somewhat narrower as a consequence of the relatively thin carbon bed depth, such as in the M50 mask filter.

In alternative embodiments, viewing windows 103 may include additional optics to display ESLI signals to the wearer of the mask. For example, viewing windows 103 may be constructed to include a small prism, mirror or fiber optic element that projects a small "heads-up" or similar display of the ESLI signals in the field of vision of the mask wearer. While ESLIs according to the present invention are deliberately designed to be passive, simple devices that are inexpensive to produce and incorporate into conventional CBRN filters, in some applications more complex indicators may be desired. For example, electronic circuits may be provided in alternative embodiments to increase the sensitivity and selectivity of colorimetric indicators, and/or to enhance the display. Such electronics may include digital or analog photodetector circuits that scan colorimetric indicators to provide enhanced detection sensitivity or/or selectivity; memory devices and microprocessors to record and process detection data; and indicators including LCD or LED displays, warning lights, audible or silent alerts, or wireless interfaces to communicate data remotely, such as to a central command.

As noted above, indicator elements 102 must be exposed to a detectible level of a target threat agent to produce a color change. For example, a detectible level may be obtained by placing the indicator element in contact with filter media that has been exposed to the target threat agent. Some regions of a filter media do not provide timely detectible levels. The location of such areas will differ depending on several factors. An ideal respirator filter would distribute airflow uniformly over the sorbent bed for maximum gas life capacity. In the real world, however, airflow is not always uniform. In some filter designs, for example, airflow may be significantly decreased or may not extend at all to the outermost regions of the carbon bed. For those filters where uniform airflow is a problem, indicator elements must be positioned or extended radially in toward an area of the sorbent bed that has reasonably good air flow to detect target threat agent wavefront penetrations in the sorbent media. Actual placement of calorimetric indicators in embodiments according to the present invention will also depend on the sensitivity of the indicator to a target threat agent or threat agent category and the concentration at which prudent warnings should be provided.

While colorimetric indicator elements 102 should be positioned to be in contact with areas of the sorbent filter bed that permit detection of levels of target threat agent penetration, indicator elements 102 should not protrude any more than necessary into the filter media to avoid reducing filter gas life capacity and potentially interfering with packing of the carbon bed during filter assembly. Uneven packing can cause vapor channeling at the interface between the sorbent and wall of the filter and result in poor gas-life performance and premature failure.

Figure 3:
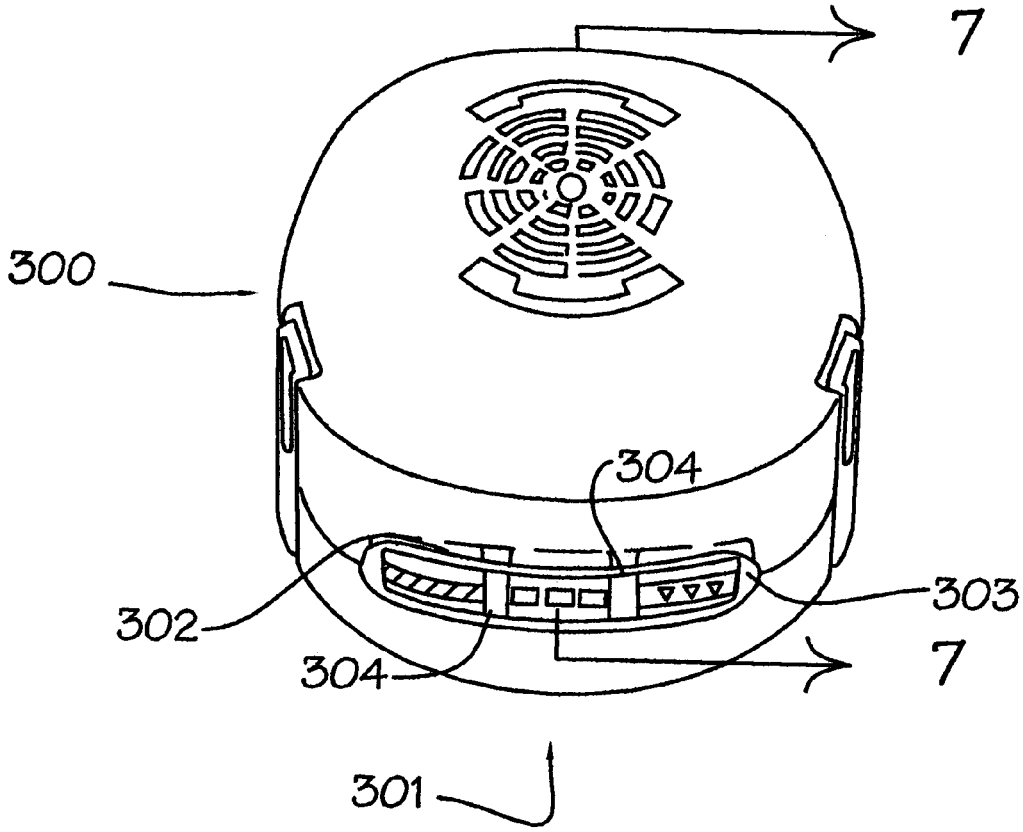
FIG. 3 shows a front perspective view of an embodiment of a multi-threat-agent multi-detector calorimetric ESLI in a snap-in low profile "bayonet"-type CBRN respirator filter according to the present invention.
Figure 4:
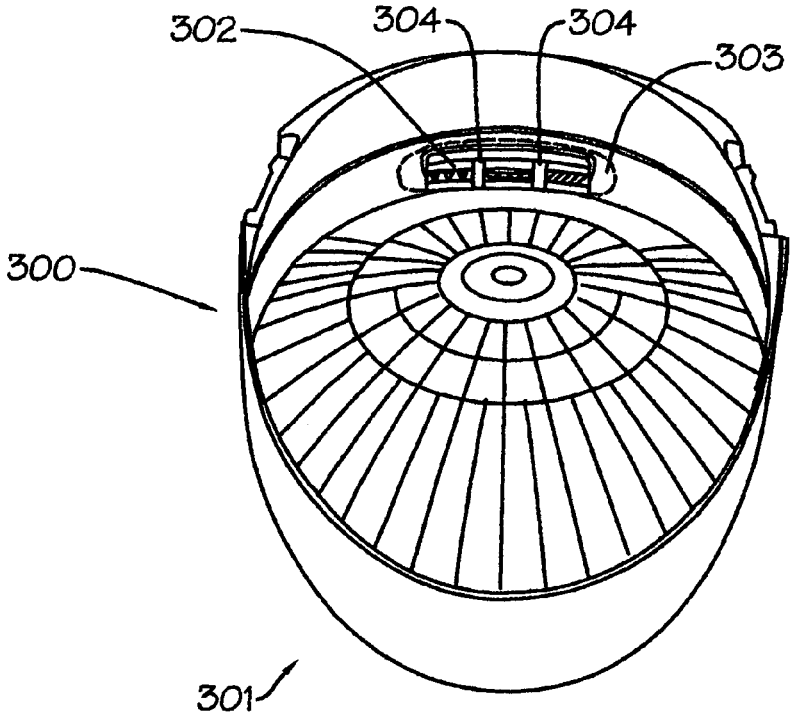
FIG. 4 shows a front perspective view of the inside of the filter housing of the snap-in low profile "bayonet"-type CBRN respirator filter illustrated in FIG. 3.

Embodiments adapted for use in a single-pass low-profile CBRN filter element such as the filter element shown in FIGS. 3, 4 and 7, are substantially of the same construction and materials as those described in connection with the FIG. 1 embodiment but are reduced in size due to the smaller bed depth of carbon/chemi sorbent media 320 in these low-profile filters. One or more viewing windows 303 may be integrated into the lower housing of the sorbent bed of the filter element as in the first embodiment, but has been appropriately scaled for use in the low profile filters. In the M50 filter, viewing windows are approximately 4 cm in length, 0.6 cm in height.

Embodiments according to the present invention incorporate colorimetric reactive compounds demonstrated to have the sensitivity and environmental stability to provide reliable ESLIs for target CWAs and TICs. Reactions of metalloporphyrins and pH sensitive dyes responsive to various CWA and TIC target challenges were examined for production of distinctive, color changes at appropriate concentration levels of toxins.

Thirty (30) different candidate metalloporphyrins and pH sensitive dyes were initially evaluated in a number of sensitivity screening tests that measured color change response times to target threat agents. The candidate colorimetric chemicals were deposited on adsorbent paper test strips and exposed in glass tubes to controlled constant vapor/gas test challenges that included the following target threat agents: the nerve agent GB (sarin), HD (mustard), CK (cyanogen chloride), AC (hydrogen cyanide), CG (phosgene), ammonia, and chlorine.

Based on the foregoing tests the field was narrowed to the following:

- metalloporphyrins: Cu (TPP), copper 5, 10, 15, and 20-tetraphenylporphyrinate(-2) and Zn (TPP), zinc 5, 10, 15, and 20-tetraphenylporphyrinate(-2)
- pH sensitive dyes: metanil yellow, rosolic acid, bromocresol green, Congo red, and bromocresol purple (acidic form).

Indicator sensitivity is defined as the Ct exposure (i.e., concentration (C) in milligrams per cubic meter multiplied by the time (t) in hours) to produce a noticeable color change in comparison to an unexposed indicator used as a reference color. The target sensitivity, also a Ct exposure value, represents a benchmark for judging acceptability of the candidate indicators. In determining target sensitivity, the minimum gas-life capacities as stated in a draft performance specification for the M50 Joint Service General Purpose Mask (JSGPM) were divided by a factor of 10 to arrive at a conservative target sensitivity value for each target threat agent. This provided an estimate of the sensitivity needed to detect the leading edge of the threat agent vapor wavefront passing through the filter sorbent bed. Indicators were considered acceptable if the measured sensitivity did not exceed the target baseline sensitivity by more than 25 percent.

The measured and target sensitivities for the above candidate indicator compounds are summarized in Table 1, attached hereto. While none of the 30 metalloporphyrins and pH sensitive dyes evaluated had sufficient sensitivity to detect CK suitable colorimetric indicators were found for all of the other target threat agents that were evaluated.

From the experimental data summarized in Table 1, Cu (TPP), metanil yellow and bromocresol green are three preferred indicators for use in one or more embodiments according to the present invention. The metalloporphyrin Cu (TPP) may be preferred over metanil yellow as an indicator for GB and chlorine due to its better color response for those threat agents. Including Cu (TPP) as a third indicator also has the advantage of redundancy since it has essentially the same sensitivity as metanil yellow for these two target threat agents.

A limited screening evaluation was conducted to assess the environmental stability of metanil yellow and Cu (TPP). The two indicators were exposed for six weeks in open glass tubes to three environmental temperature extremes representing arctic, tropic and desert climatic conditions for packaged storage per the draft JSGPM filter specification (see Table 2). After exposure the two indicators were visually inspected for physical and color degradation and found to be unaffected by the storage conditions. Following inspection, the environmentally conditioned indicators were then tested with GB and CG using the same methods previously used to determine baseline threat agent sensitivity. Unconditioned indicators were included in each test as controls to directly compare the sensitivity measurements. Both metanil yellow and Cu (TPP) demonstrated excellent environmental stability. As shown in Table 2, the sensitivity results for the environmentally conditioned indicators were not different from the controls. Although limited in scope, the results of this evaluation indicate that embodiments incorporating metanil yellow and Cu (TPP), are estimated to have a minimum shelf life of 5 years and would be suitable for worldwide military operations where temperature/humidity storage extremes are routinely encountered in the field.

As can be seen from the experimental data summarized in Table 1, other indicator compounds also demonstrated sensitivity well in excess of the baseline sensitivities (excepting, at the present time, CK) and also appear to be suitable for use in embodiments according to the present invention. In addition, as those of skill in the art will recognize, the results from Table 1 may readily be interpreted to extend to other chemical hazards not specifically evaluated, as may be required by different users and/or changes in the threat. One or more indicators may also be exchanged to target different groups or specific individual toxic vapors or gases to satisfy the specific needs of the user.

Indicator compounds other than those listed in Table 1 may also be used in one or more embodiments according to the present invention. For example, several colorimetric indicator film products have been developed for the U.S. joint services. In particular, K&M Environmental Inc, Virginia Beach, Va. and ChemMotif Inc., Concord, Mass., are both developing such films independently. These films, which are understood by applicant to be proprietary and not based on any of the indicator chemicals listed in Table 1, have been tested and evaluated and the results show, at least with respect to some films, that they may also be used as indicators of the target conventional CWAs described herein, including CK. As of the filing date of this application, these proprietary films, or their equivalents, would be needed, alone or in combination with the indicator films developed by applicant, in embodiments of the present invention that provide CK detection. Applicant's research and the research of others is ongoing and new indicator compounds capable of being used in one or more embodiments are likely to be developed.

Figure 5:
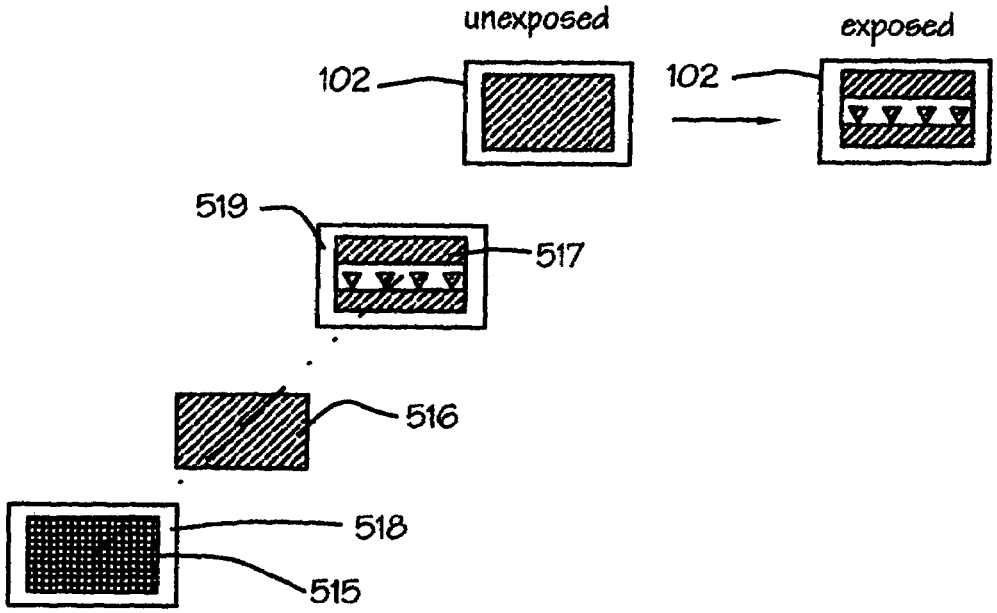
FIG. 5 shows an exploded view of component layers of a calorimetric indicator according to an embodiment of the present invention.

FIG. 5 illustrates an exploded view of a multi-layer colorimetric indicator element 102 according to an embodiment of the present invention. Each calorimetric indicator element 102 is substantially rectangular in shape and includes three thin layers: a protective barrier layer 515 having an outer surface facing toward the filter media inside the filter, a sensing layer 516 in the middle, and a mask overlay 517 on the opposite side facing the filter housing and viewing window 103. The multiple layers are sandwiched together by adhesive tape sections 518 and 519 which are adhered along the peripheral edges of the outer surfaces of protective barrier layer 515 and mask overlay 517, respectively. Adhesive tape sections 518 and 519 extend beyond the peripheral edges of these opposing outer surfaces to form narrow boarders with inward facing adhesive surfaces that are attached together to secure the layers of the colorimetric indicator element 102 in between. Tape 519 preferably also provides adhesive on both sides so that it can be used to adhere the colorimetric indicator element to the inside surface of the filter housing in position behind a viewing window. Tapes sections 518 and 519 preferably are made from a very thin flexible adhesive tape that is chemically and heat resistant, such as Mylar®, or the like. Overall, the total thickness of an assembled colorimetric indicator element 102 as described above may be manufactured to be as narrow as approximately 0.5 mm which will greatly reduce the possibility of interfering with packing of the sorbent bed.

Protective barrier 515 provides a backing for sensing layer 516 to shield it from abrasive damage that might result if sensing layer 516 were to come directly in contact with sorbent bed 120. Protective barrier 515 is preferably made from a porous non-woven polyester mesh fabric, or a similar non-chemically reactive air permeable material. Protective barrier 515 may also be employed to control the rate of vapor diffusion toward sensing layer 516. The aperture size of protective barrier 515 may be adjusted to arrive at an appropriate rate of diffusion for a target threat agent. For example, a film could be desensitized by reducing the rate of diffusion in this way. Additional layers may also be used in some embodiments to control the rate of gas diffusion.

Sensing layer 516 is made from a flexible, transparent acrylic, polyester or another suitable substrate material that is coated with a calorimetric indicator compound such as the compounds described above, that produces a distinct color change in response to a target threat agent or a class thereof. The thickness of the colorimetric coating applied to the substrate will also generally influence indicator sensitivity reaction times and is another parameter that can be adjusted to calibrate warning signals to indicate when a target threat agent has achieved a predetermined level of progress through a sorbent filter media.

Mask overlay 517 is preferably made from a polyester film that is substantially the same color as the unexposed sensing layer 516 and provides an overlay or template above sensing layer 516 to expose selected warning signal regions in sensing layer 516. For example, mask overlay 517 may be used to selectively reveal signal regions corresponding to predetermined levels of target threat agent penetration through the sorbet filter media.

In general, colorimetric indicators should be calibrated so that warning signals are displayed before a target threat agent vapor penetrates a sorbent bed to a level that would exceed a prudent safety margin. CWAs, TICs and other threat agents fall into several different chemical categories and can progress through a respirator filter media at different rates. For example, gas lives are generally much shorter for weakly adsorbed threat agents (high vapor pressure) than for strongly adsorbed threat agents (low vapor pressure). For weakly chemi-adsorbed toxic vapors and gases (e.g., cyanogen chloride and phosgene), the signal region exposed by mask overlay 517 preferably is located at a predetermined position in sensing layer 516 so that when the warning signal is visible the remaining gas-life capacity (i.e., service life) is approximately 40 to 60% to allow sufficient time for the user to change the filter. For strongly physically adsorbed vapors (e.g., sarin and mustard), the signal region exposed by mask overlay 517 is located at a predetermined position in sensing layer 516 so that the signal is visible when the remaining service life of the filter is approximately 60 to 80% since breakthrough times are generally much longer for these threat agents.

In another aspect of the present invention, mask overlay 517 may provide a template of shapes, symbols, patterns and forms for color changes produced by sensing layer 516. The use of distinctive patterns or symbols such as checker boards, stripes, stars, hash marks, or other suitable, easily identifiable shapes, contours, patterns or symbols, will improve readability and facilitate interpretation of the display. The use of such representations will greatly simplify the process of determining when it is time to change CBRN filters or masks for every user. In addition, indications that employ distinctive shapes and the like will be particularly useful in circumstances where colors may be difficult or impossible to distinguish such as in low light conditions or by persons with color deficient vision. Although "go no-go" indicators will generally be preferred for their simplicity, in some applications a progressive display may be desired. For example, a series of apertures may be provided in mask layer 517 to reveal areas of color changes in the underlying film corresponding to progressively greater levels of threat agent filter penetration. The display may, for example, provide different shapes or patterns or shapes that increase in size corresponding to the level of filter penetration. Multiple mask layers may also be used in some other embodiments. For example, the use of several layers may simplify the manufacturing process and provide for different symbol combinations by combining different sets of mask layers. In still other embodiments a mask layer may be applied as a coating directly to the outer surface of sensing layer 516. Still other embodiments may stack multiple sensing layers 516 each with a distinct colorimetric region responsive to a different target threat that can be seen through transparent regions in sensing layers 516 positioned above. In other alternative embodiments, mask overlay 517, viewing window 103 or one or more additional layers may provide filtering to tint, color shift, polarize, or otherwise enhance display of the underlying color. In still other alternative embodiments, mask overlays for one or more adjacent colorimetric indicator elements may be combined into a single mask. In yet other embodiments, an adhesive may be applied directly to a substrate or sensing layer thus eliminating the need for separate adhesive layers.

Embodiments according to the present invention may be incorporated in a wide variety of respirator filter devices. For example, an ESLI according to the present invention may be integrated into the filter body of a U.S. military M50-series chemical protective mask (i.e., the Joint Service General Purpose Mask) as shown in FIGS. 3, 4 and 7. In the M50 mask, two identical single-pass low-profile CBRN filter elements are used, each having a carbon bed depth of approximately 1 cm. FIGS. 3 and 4 show perspective internal and external views, respectively, of a low profile CBRN filter element 300 such as may be used in an M50 type respirator. Similar to filter 100, filter 300 includes a HEPA particulate media 330, a carbon/chemi sorbent media 320 with a carbon fines filter 322 to prevent passage of loose carbon particles. A multi-threat-agent ESLI assembly 301 similar to the ELSI assemblies described above includes an array of three equally spaced and visually distinct adjacent colorimetric indicators 302. Because there is less room available for an indicator in the low profile filter element 300 of the M-50 this embodiment provides a narrower display and the array of colorimetric indicators 302 has been positioned behind a single viewing window 303. The use of a single window allows a reduction in the overall size of the display and may in some applications facilitate manufacturing of the ESLI display. As in the embodiments described above, window 303 may be made from a suitably transparent and chemical and heat resistant material such as polycarbonate resin, or the like, and preferably is polished to enhance visibility. To further enhance visibility of the smaller display window 303 may be provided with a convex surface that magnifies the warning signals produced by colorimetric indicators 302.

Individual calorimetric indicators 302 are mounted to the back of viewing window 303 by a chemically resistant adhesive tape backing 304 that is of a contrasting color (such as black, the color as the filter housing in this example) and are separated spatially over the tape backing 304 to provide good visual contrast between the indicators. Tape backing 304 provides an adhesive perimeter for affixing the ESLI indicator to the filter housing behind window 303. The dimensions of the viewing window for the low profile filter element 300 shown in FIGS. 3 and 4 are approximately 4.0 cm in length, 0.6 cm in height, and have a center thickness that provides contact with an area of the sorbent bed that can be used to indicate threat agent penetration. The area selected should have reasonably good airflow. In particular, low flow areas near the sidewall should be avoided. ESLI assembly 301 is otherwise of the same basic construction as the embodiments described above and can be made from substantially similar components and materials as previously described. Dimensions may vary depending on the particular application. For example, a single viewing window for a CA21 canister would be approximately 6.0 cm in length and 1.0 cm in height. Viewing windows and other related components may likewise be scaled to suit the needs of a particular application.

CONCLUSION

As has been shown, embodiments according to the present invention employ an array of colorimetric indicator elements in a colorimetric display that will provide timely warning of the need to change a filter element nearing the end of its gas-life capacity. Multiple colorimetric indicator elements are employed to detect filter media penetration by a wide range of target threat hazards including conventional chemical warfare agents and toxic industrial chemicals. The indicators are calibrated to provide a warning signal when filter penetration by any target threat agent reaches a level corresponding to an established end of service penetration level for that particular threat agent or threat agent category. Signals from each colorimetric indicator element are spatially separated and visually distinct and configured to display easily interpreted patterns or symbols indicative of filter gas-life capacity. The signals can be magnified by a convex window display to improve readability without increasing the footprint size of the indicator.

A number of embodiments of the invention defined by the following claims have been described. Nevertheless, it will be understood that various modifications to the described embodiments may be made without departing from the spirit and scope of the claimed invention. Accordingly, other embodiments are within the scope of the invention, which is limited only by the following claims.

TABLE 1

Threat Agent Sensitivity Measurements for Lead Candidate Indicator Chemicals

| Target Threat Agent | Indicator Compound | Color Change | Indicator Sensitivity ($mg/m^3 \times hr$) | Target Sensitivity ($mg/m^3 \times hr$) | Test Conc. ($mg/m^3$) |
|---|---|---|---|---|---|
| | | Conventional Chemical Warfare Agents | | | |
| GB | Cu(TPP) | pink → orange-red | 10 | 250 | 10 |
| | Metanil yellow | yellow → tan | 19 | | 90 |
| | Rosolic acid (basic form) | red → yellow | 24 | | |
| HD | Metanil yellow | yellow → tan | 20 | 250[b] | 5 |
| CK | None | NA | NA | 67 | 400 |
| AC[a] | Bromocresol green (acid) | orange-red → peach | 82 | 67 | 1,630 |
| CG[a] | Metanil yellow | yellow → tan | 43 | 250 | 400 |
| | Congo Red | red → purple | 33 | | |

TABLE 1-continued

| Threat Agent Sensitivity Measurements for Lead Candidate Indicator Chemicals | | | | | |
|---|---|---|---|---|---|
| Target Threat Agent | Indicator Compound | Color Change | Indicator Sensitivity ($mg/m^3 \times hr$) | Target Sensitivity ($mg/m^3 \times hr$) | Test Conc. ($mg/m^3$) |
| | | Toxic Industrial Chemicals | | | |
| Chlorine | Zn(TPP) | pink → olive | 10 | 200[c] | 400 |
| | Cu(TPP) | red → red-brown | 10 | | |
| | Metanil yellow | yellow → tan | 10 | | |
| Ammonia | Bromocresol purple (acid) | orange → purple | 3 | 70 | 350 |
| | Bromocresol green (acid) | orange-red → blue | 7 | | 400 |

[a]AC and CG are also considered TICs since they are commercially produced for various industrial applications.
[b]Based on dimethyl methylphosphonate (DMMP), a nerve agent simulant, minimum gas-life capacity of JSGPM filter
[c]Based on estimated minimum gas-life capacity for C2A1 canister

TABLE 2

| Environmental Screening Results: Threat Agent Sensitivity Measurements for Metanil Yellow and Cu(TPP) after 6 Weeks Storage | | | | | | |
|---|---|---|---|---|---|---|
| | | | Indicator Sensitivity ($mg/m^3 \times hr$) | | | |
| Target Threat Agent | Indicator Compound | Test Conc. ($mg/m^3$) | Control ~23° C. 50% RH | Desert 71° C. 15% RH | Arctic −46° C. <20% RH | Tropic 45° C. 85% RH |
| GB | Metanil yellow | 50 | 5 | 5 | 5 | 5 |
| | Cu(TPP) | | 58 | 58 | 58 | 58 |
| CG | Metanil yellow | 400 | 7 | 7 | 7 | 7 |

What is claimed is:

1. A filter for an air-purifying respirator, comprising:

a filter housing having a chamber for a filter media and at least one viewing window in said housing;

a sorbent filter media positioned in said filter media chamber, said sorbent filter media comprising a sorbent bed effective for gas filtration; and a plurality of colorimetric indicator elements positioned adjacent to one another within the sorbent bed and behind said at least one viewing window, wherein each of said colorimetric indicator elements is configured to display a distinct color change signal in response to detection of a predetermined level of filter penetration of a chemical threat agent or threat agent category corresponding to an end-of-service-life condition of the sorbent filter media, and wherein said indicator elements are positioned within the sorbent bed so that said indicators are exposed to and detect target agent wavefront penetration in an area inside the sorbent bed adjacent a side wall of the filter, and not at the effluent side or edges of the sorbent bed, said indicator elements comprising a sensing side and a display side, the display side positioned behind said at least one viewing window and the sensing side positioned substantially in contact with an internal area of the sorbent bed having sufficient airflow.

2. The filter of claim 1, wherein said colorimetric indicator elements further comprise a mask overlay that forms a distinct shape, symbol or pattern through which the color changes are shown so that the signal comprises a visually distinct symbol, shape or form.

3. The filter of claim 1, wherein the predetermined level of filter penetration through the sorbent filter media corresponds to a remaining gas-life capacity of approximately 40 to 60% for a weakly adsorbed chemical threat agent and a remaining gas-life capacity of approximately 60 to 80% for a strongly adsorbed chemical threat agent.

4. The filter of claim 1, wherein said color change signal comprises a "go no-go" indication for changing the respirator filter.

5. The filter of claim 1, wherein the calorimetric indicator elements include a reactive chemical compound selected from the group consisting of: metalloporphyrins Cu (TPP), copper 5, 10, 15, 20-tetraphenylporphyrinate(-2), and Zn (TPP), zinc 5, 10, 15, 20-tetraphenylporphyrinate(-2); and pH sensitive dyes: 3-(4-Anilinophenylazo)benzenesulfonic acid monosodium salt (Metanil yellow), rosolic acid (basic form), bromocresol green, 1-Napthalensulfonic acid (Congo red), and bromocresol purple (acidic form).

6. The filter of claim 5, wherein said plurality of colorimetric indicator elements are displayed against a background that contrasts visually with the reactive chemical compounds in the calorimetric indicator elements.

7. The filter of claim 1, wherein said plurality of colorimetric indicator elements further comprises an air permeable protective barrier positioned between said sorbent bed and said sensing side, said protective barrier configured to control the rate of vapor and gas diffusion of the chemical threat agent or threat agent category toward the sensing side.

* * * * *